US011959725B2

(12) United States Patent
Faizan et al.

(10) Patent No.: US 11,959,725 B2
(45) Date of Patent: Apr. 16, 2024

(54) DEEP SEA PRESSURE BASED PROJECTILE LAUNCHING SYSTEM

(71) Applicant: Mirza Faizan, Irving, TX (US)

(72) Inventors: Mirza Faizan, Irving, TX (US); Aroush Fatima, Patna (IN); Arifa Fatima, Patna (IN); Ashaz Haque, Patna (IN); Zayd Khan, Irving, TX (US); Omar Farooq Khan, Irving, TX (US); Wafiqah Zubair, Irving, TX (US); Rida Siddiqui, Katy, TX (US); Abdullah Nouiouat, Irving, TX (US); Abdurraheem Sheikh, Irving, TX (US); Hamza Ahmed, Murphy, TX (US); Mirza Rizwan, Patna (IN)

( * ) Notice: Subject to any disclaimer, the term of this patent is extended or adjusted under 35 U.S.C. 154(b) by 101 days.

(21) Appl. No.: 17/184,956

(22) Filed: Feb. 25, 2021

(65) Prior Publication Data

US 2022/0099408 A1 Mar. 31, 2022

Related U.S. Application Data

(60) Provisional application No. 62/982,076, filed on Feb. 27, 2020.

(51) Int. Cl.
*F41F 3/07* (2006.01)

(52) U.S. Cl.
CPC ..... *F41F 3/07* (2013.01)

(58) Field of Classification Search
CPC ..... F41F 3/07; F41F 3/077
USPC ..... 89/1.809, 1.81
See application file for complete search history.

(56) References Cited

U.S. PATENT DOCUMENTS 3,516,380 A * 6/1970 Johnston ..... F41F 3/10 114/238
3,857,321 A * 12/1974 Cohen ..... F41F 3/10 114/238
4,643,072 A * 2/1987 Hillebrecht ..... F41F 3/07 89/1.81
4,848,210 A * 7/1989 Bissonnette ..... F41F 3/10 114/319
5,044,253 A * 9/1991 Moody ..... F41F 3/10 114/238
5,085,122 A * 2/1992 Berlam ..... F41F 3/10 114/319
5,099,745 A * 3/1992 Hubbell ..... F41F 3/10 114/238
5,200,572 A * 4/1993 Bissonnette ..... F41F 3/10 114/238
5,210,369 A * 5/1993 Cassidy ..... F41F 3/10 114/238
5,231,241 A * 7/1993 Bissonnette ..... F41F 3/10 114/238
5,645,006 A * 7/1997 Moody ..... B63G 8/32 114/319

(Continued)

*Primary Examiner* — Joshua E Freeman
*Assistant Examiner* — Benjamin S Gomberg

(57) ABSTRACT

A projectile launching apparatus for launching projectile with the pressure exerted by the seawater. The projectile launching apparatus includes a large barrel launch, a piston, one or more piston stoppers, plurality of hinged doors, piston locks, and a plurality of water pump is available at bottom of the barrel to generate pressure and help to launch the projectile, wherein the assembly for the projectile is less expensive than present systems, lighter in weight, and of less complexity.

6 Claims, 1 Drawing Sheet

(56) References Cited

U.S. PATENT DOCUMENTS

| | | | | | |
|---|---|---|---|---|---|
| 5,834,674 | A * | 11/1998 | Rodriguez | F41F 3/10 | 114/238 |
| 6,164,179 | A * | 12/2000 | Buffman | F41F 3/07 | 114/316 |
| 6,318,229 | B1 * | 11/2001 | Nevels | F41F 3/04 | 89/1.816 |
| 6,401,645 | B1 * | 6/2002 | Ansay | B63G 5/00 | 114/238 |
| 6,871,610 | B1 * | 3/2005 | Galliano | B63G 5/00 | 114/316 |
| 7,140,289 | B1 * | 11/2006 | Ansay | F41F 3/07 | 114/319 |
| 7,451,680 | B1 * | 11/2008 | Pelto | F41F 3/10 | 124/71 |
| 8,662,441 | B2 * | 3/2014 | Powell | B63G 8/30 | 89/1.809 |
| 8,936,016 | B1 * | 1/2015 | Phelps | F41F 3/07 | 124/71 |
| 10,514,232 | B2 * | 12/2019 | Smoker | F41F 3/07 | |
| 10,571,222 | B2 * | 2/2020 | Strocchia-Rivera | F41F 3/07 | |
| 2019/0072362 | A1 * | 3/2019 | Strocchia-Rivera | F41F 3/07 | |

* cited by examiner

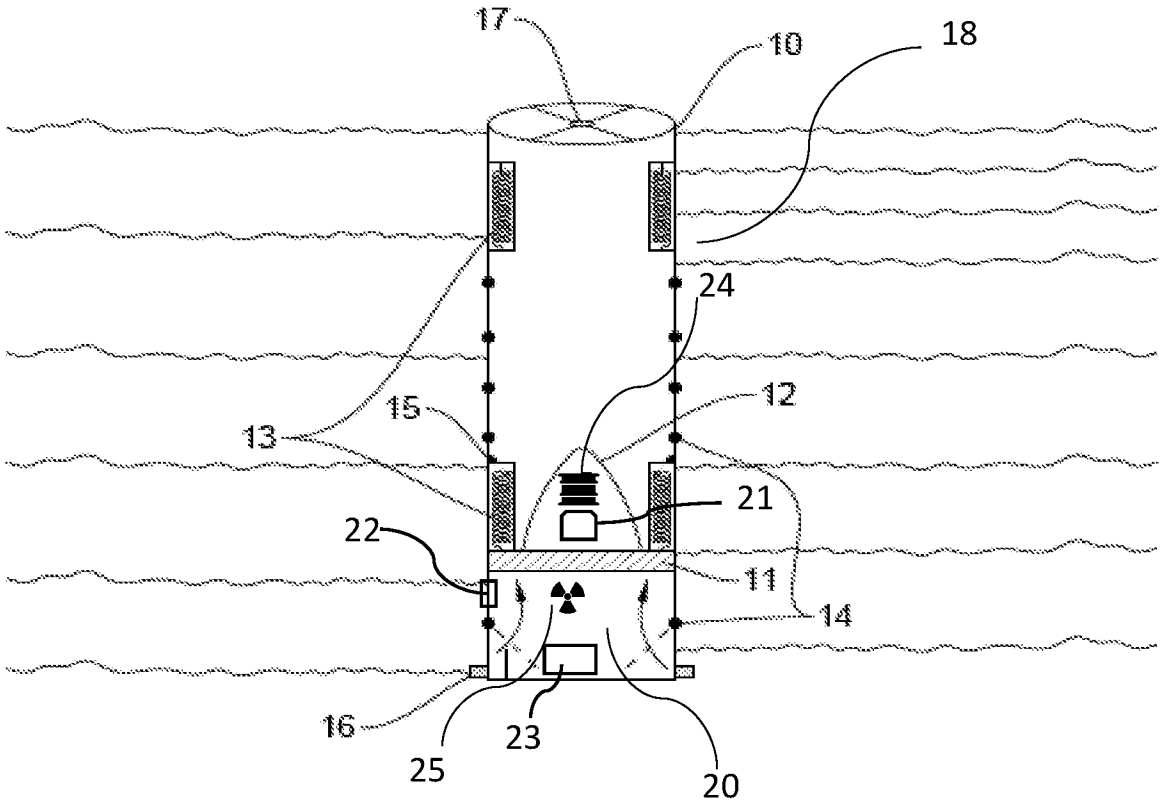
10
17
18
24
12
21
11
14
20
23
25
16
22
15
13

DEEP SEA PRESSURE BASED PROJECTILE LAUNCHING SYSTEM

TECHNICAL FIELD

The present invention relates generally to projectile launchers and more specifically the invention relates to the projectile launchers which utilize pressure generated by water as a propellant.

BACKGROUND OF THE INVENTION

Launching a projectile is one of the most important endeavors in human history. From the launch of the first arrow by a human to today's rocket launches, human civilization has come a long way. Earlier projectile launches used the brute force of human hand, then we slowly advanced to mechanical systems like a catapult and finally to a controlled explosion like that in a gun or even rocket launchers. To launch a large projectile, like missile or rockets, we need to add engines to the projectiles and burn lots of fuel to constantly power them towards their destination. Furthermore, to throw a projectile far, we needed to do more powerful explosions, which presents accident hazards.

There was a need for a method to launch a heavy projectile without using any controlled explosion at high speed, thereby enabling it to go far or high.

For decades, projectile launchers have been popular. One method of launching rockets or projectile has been with the use of solid-fuel rocket engines. Solid-fuel rocket engines provide ample thrust to launch a rocket Several hundred feet into the air. However, there are many dangers involved with the use of solid fuel engines, and are not cost-effective.

Further conventionally used designed to include pressure tank in which pressurized air or water is Stored and expelled through a nozzle to propel the projectile, as described in U.S. Pat. No. 5,415,153.

Another popular method of launching projectiles has been with a launcher which utilizes compressed behind the rocket to propel it forward, as shown in U.S. Pat. No. 5,653,216. While these rockets do not utilize dangerous Solid fuel-burning engines they typically do not have enough power to propel the rocket to great heights.

All of these conventional methods/systems, and some other methods/systems presently known in the art have had some flaws in design or mechanism and lacks precision. Most of the existing devices are too expensive, complex, and heavy in weight as compare to existing systems and consuming to be practical for most users. Some shortfalls of the existing method include manual interference. In light of this, there is a need for a method/system that overcomes these constraints.

An example of a projectile currently available and intended for use in the projectile launching apparatus of the prior art, as well as the invention described herein, is the 40 mm cartridge grenade used by the U.S. Army and other military forces. This 40-mm cartridge includes a self-contained propellant that is ignited by a percussion primer to propel a grenade or other type of projectile.

None of the above inventions and patents, taken either singly or in combination, is seen to describe the present invention as claimed. Thus, a launcher that can propel a projectile Such as a rocket or mines, missiles with great velocity by using pressure by the water that solving the aforementioned problems is desired.

Accordingly, there is also a need for a launcher that can propel a projectile Such as a rocket or mines, missiles with great velocity by using pressure by the water but without a prolonged burning of fuel. It is to the provision of such therefore that the present invention is primarily directed.

Features and advantages of the invention will be set forth in the description that follows, and in part will be apparent from the description, or may be learned by practice of the invention. The advantages of the invention will be realized and attained by the structure particularly pointed out in the written description and claim hereof as well as the appended drawings.

It is to be understood that both the foregoing general description and the following detailed description are exemplary and explanatory and are intended to provide further explanation of the invention as claimed.

The present invention addresses the issues discussed above.

SUMMARY OF THE INVENTION

The object of the present invention is to overcome the disadvantages of the prior arts and to provide projectile launching apparatus for launching the projectile, wherein the apparatus consists of a large launch barrel, a piston, one or more piston stoppers, a plurality of hinged doors, piston locks, and a plurality of water pump is available at bottom of the barrel to generate pressure and help to launch the projectile, wherein the assembly for the projectile is less expensive than present systems, lighter in weight, and of less complexity.

It is another object of the present invention to provide the projectile launching apparatus for launching the projectile, wherein the plurality of water pump is available at bottom of the barrel positioned within the launch barrel So as to immerse energy Supplied to the barrel causing rapid pressurization of the piston which causes a projectile thereon to be propelled.

It is another object of the present invention to provide the projectile launching apparatus for launching the projectile, wherein the apparatus can also use a unit to convert a portion of the water into hydrogen gas and oxygen gas, and whereby the Spark generating means ignites the hydrogen gas causing rapid pressurization of the piston which causes a projectile thereon to be propelled.

It is another object of the present invention to provide the projectile launching apparatus for launching the projectile, wherein the water may be stored within the barrel, and also an air may be pumped into the barrel into the launching apparatus using actuating the pump. Also, substantial positive air pressure may be created within the barrel within the launching apparatus, after which the projectile may be released from the piston and may advance away from the launching apparatus by the pressurized water in the barrel of the launching apparatus.

It is another object of the present invention to provide the projectile launching apparatus for launching the projectile, wherein a pump is connected to the inlet of the launching apparatus, the pump is connected for and capable of pumping water into the barrel at a pressure sufficient to launch the projectile.

A one-way plurality of hinged doors is connected to the pump and permits the flow of water only to the launching apparatus. There is a projectile assembly located on the piston in the barrel of the launching apparatus. There is also a liquid reservoir for receiving liquid.

With the above and other objects in view, as will hereinafter appear, another object of the feature of the present invention is the provision of an assembly for launching projectile from an underwater platform.

It is another object of the present invention to provide the projectile launching apparatus for launching the projectile, wherein the projectile launching apparatus could be made using a long vacuum tube on the surface of the earth and allowing water to gush in, thereby creating high-speed motion to the piston available in the projectile launching apparatus, wherein the projectile is fixed above the piston, the launching apparatus comprises a barrel within which the projectile fits, further, the launching apparatus comprises a source of pressurized water to released pressure to propel the projectile.

The above and other features of the invention, including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention Other objects, advantages, and features of this invention will become more apparent from the following description.

The details of one or more implementations are set forth in the accompanying description below. Other aspects, features, and advantages of the subject matter disclosed herein will be apparent from the description and the claims.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

Features, elements, and aspects of the invention that are referenced by the same numerals in different figures represent the same, equivalent, or similar features, elements, or aspects in accordance with one or more embodiments.

The following figure depicts a certain illustrative embodiment of the invention. This depicted embodiment is to be understood as illustrative of the invention and not as limiting in any way.

Referring particularly to the drawing for illustration only and not limitation, there is illustrated:

FIG. 1 view showing a projectile launching apparatus and projectile as according to the present invention.

DRAWINGS—REFERENCE NUMERALS

10 Launch barrel
11 Piston
12 Projectile
13 Piston stopper mechanism
14 Hinged door
15 Piston lock
16 Water pump Inlet
18 projectile launching apparatus
17 Camera lens type opening
20 Collector unit

DETAILED DESCRIPTION OF DRAWINGS

The present disclosure is best understood with reference to the detailed figures and description set forth herein. Various embodiments are discussed below with reference to the figures. However, those skilled in the art will readily appreciate that the detailed descriptions given herein with respect to the figures are simply for explanatory purposes as the methods and systems may extend beyond the described embodiments. For example, the teachings presented and the needs of a particular application may yield multiple alternate and suitable approaches to implement the functionality of any detail described herein. Therefore, any approach may extend beyond the particular implementation choices in the following embodiments described and shown.

References to "one embodiment," "an embodiment," "at least one embodiment," "one example," "an example," "for example," and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in an embodiment" does not necessarily refer to the same embodiment.

With reference to FIG. 1, there is shown a projectile launching apparatus 18 in the preferred form of the invention. The projectile launching apparatus 18 has a launch barrel 10 and a piston 11. The piston 11 is in water communication with the piston. The projectile launching apparatus 18 also includes a collector unit 20.

FIG. 1 shows the overall view of the present invention. The projectile launching apparatus for launching the projectile consists of a large launch barrel 10 which is placed under the sea. A piston 11 can move to the length of the barrel. A Projectile 12 to be launched is kept on the piston 11. A plurality of Piston stoppers 13 is attached at the top end of the barrel. A plurality of hinged doors 14 on the body of the barrel, wherein the Piston is held in its position before launching at the bottom by using a plurality of Piston Locks 15. Further, the projectile launching apparatus comprising a Plurality of water pump inlet 16 at the bottom of the said barrel.

According to an embodiment of the present invention, the collector unit 20 has a pressure sensor 22 to sense the pressure within the collector unit 20, and based on the sensed data a camera lens type opening 17 works in an open/close position.

The projectile launching apparatus 18 consists of a large launch barrel 10 which is placed under the sea, wherein the length of the barrel depends on the speed and range requirement for the projectile to be launched. The projectile launching apparatus 18 included piston 11 which move the length of the barrel once the hinged door 14 below the piston is opened and high-pressure water gushes in the projectile launching apparatus 18, wherein the water in the bottom of the projectile launching apparatus 18 from the sea exerts very high pressure reaching an extreme pressure of up to 110 million Newton/Meter2 at 11 kilometers. Projectile 12 to be launched is kept on piston 11 which moves at high speed due to water pressure exerted by the water from the sea. Furthermore, the projectile launching apparatus 18 includes the Plurality of Piston stopper 13, wherein the piston stoppers are attached to the front sides of the piston, as shown in FIG. 1, around the circumference. There is also a plurality of piston stopper 13 attached at the top end of the barrel.

The piston stopper is made up of rubber plates at the one end and strong springs and aligned to slow down the piston at another end. The moment Piston Stoppers 13 collide; a transmitter in the projectile launching apparatus 18 sends signals to a camera lens type opening to open the mouth of the barrel for the projectile to be launched. Once the projectile is launched, the camera lens type opening closes.

Further, the projectile launching apparatus 18 includes a plurality of hinged doors 14 on the body of the barrel. As the piston moves up and passes through a sensor at the hinged door, the hinged doors 14 opens thus allowing high-pressure water to gush in giving speed and power to the piston to launch the projectile. The piston is held in its position before launching at the bottom of the barrel of the projectile launching apparatus 18 by using Piston Locks 15. The plurality of the water pump inlet 16 is available at the bottom of the barrel to take out the water from the barrel of the projectile launching apparatus 18 after the launch of the projectile, using a water pump 25.

According to another embodiment of the invention, depending on the length of the barrel, this invention may be used to launch various projectile like a missile and even sending satellites in space at a fraction of cost, since it will eliminate the need of initial stage rockets.

According to another embodiment of the invention, the projectile 12 includes an engine 21 to launch the projectile 12 to further height using fuel 24.

It should be understood that the launch may be used to propel any type of projectile. Examples of Such projectiles include the projectile mounted to the interior of the barrel launch, Such as a pellet any missile, or rocket, etc.

The invention is therefore based on the object to develop projectile launching apparatus 18 of the kind mentioned at the beginning which permits a low-noise, cost-effective, launching of projectiles and missiles.

In accordance with another feature of the invention, a piston is extending over the cross-section of the barrel launch and is arranged between the collector unit 20 and the projectile, said piston separates the collector unit 20 from the projectile and is caught within the fixed portion of the barrel launch immediately after the projectile left the barrel launch. This design measure can be realized in an extremely simple way with only a little expenditure of material and leads to an especially handy, sound-damped launching tube without any appreciable increase in weight.

According to an embodiment of the invention, the control unit 23 includes a processor or controller and memory.

In yet another embodiment of the present invention, the pressure sensor detects the pressure of the water and sends a signal to the control unit 23, wherein the control unit 23 automatically controls the start/stop operation without human intervention.

It is therefore submitted that the instant invention has been shown and described in what is considered to be the most practical and preferred embodiments. It is recognized, however, that departures may be made within the scope of the invention and that obvious modification will occur to a person skilled in the art. With respect to the above description then, it is to be realized that the optimum dimensional relationships for the parts of the invention, to include variations in size, materials, shape, form, function, and manner of operation, assembly, and use, are deemed readily apparent and obvious to one skilled in the art, and all equivalent relationships to those illustrated in the drawings and described in the specification are intended to be encompassed by the present invention.

It is noted that various connections are set forth between elements in the description and in the drawings (the contents of which are included in this disclosure by way of reference). It is noted that these connections in general and, unless specified otherwise, may be direct or indirect and that this specification is not intended to be limiting in this respect. In this respect, a coupling between entities may refer to either a direct or an indirect connection.

Various embodiments of the invention have been disclosed. However, it should be apparent to those skilled in the art that modifications in addition to those described, are possible without departing from the inventive concepts herein. The embodiments, therefore, are not restrictive, except in the spirit of the disclosure. Moreover, in interpreting the disclosure, all terms should be understood in the broadest possible manner consistent with the context. In particular, the terms "comprises" and "comprising" should be interpreted as referring to elements, components, or steps, in a non-exclusive manner, indicating that the referenced elements, components, or steps may be present, or utilized, or combined with other elements, components, or steps that are not expressly referenced.

The disclosed methods and systems, as illustrated in the ongoing description or any of its components, may be embodied in the form of a computer system. Typical examples of a computer system include a general-purpose computer, a programmed microprocessor, a micro-controller, a peripheral integrated circuit element, and other devices, or arrangements of devices that are capable of implementing the steps that constitute the method of the disclosure.

The computer system comprises a computer, an input device, a display unit, and the Internet. The computer further comprises a microprocessor. The microprocessor is connected to a communication bus. The computer also includes a memory. The memory may be Random Access Memory (RAM) or Read-Only Memory (ROM). The computer system further comprises a storage device, which may be a hard-disk drive or a removable storage drive, such as, a floppy disk drive, optical-disk drive, and the like. The storage device may also be a means for loading computer programs or other instructions into the computer system. The computer system also includes a communication unit. The communication unit allows the computer to connect to other databases and the Internet through an input/output (I/O) interface, allowing the transfer as well as the reception of data from other sources. The communication unit may include a modem, an Ethernet card, or other similar devices, which enable the computer system to connect to databases and networks, such as, LAN, MAN, WAN, and the Internet. The computer system facilitates input from a user through input devices accessible to the system through an I/O interface.

To process input data, the computer system executes a set of instructions that are stored in one or more storage elements. The storage elements may also hold data or other information, as desired. The storage element may be in the form of an information source or a physical memory element present in the processing machine.

The programmable or computer-readable instructions may include various commands that instruct the processing machine to perform specific tasks, such as steps that constitute the method of the disclosure. The systems and methods described can also be implemented using only software programming or using only hardware or by a varying combination of the two techniques. The disclosure is independent of the programming language and the operating system used in the computers. The instructions for the disclosure can be written in all programming languages including, but not limited to, "C," "C++," "Visual C++," Java, and "Visual Basic." Further, the software may be in the form of a collection of separate programs, a program module containing a larger program, or a portion of a program module, as discussed in the ongoing description. The software may also include modular programming in the form of object-oriented programming. The processing of input data by the processing machine may be in response to user commands, the results of previous processing, or from a request made by another processing machine. The disclosure can also be implemented in various operating systems and platforms including, but not limited to, "Unix," "DOS," "Android," "Symbian," and "Linux."

The programmable instructions can be stored and transmitted on a computer-readable medium. The disclosure can also be embodied in a computer program product comprising a computer-readable medium, or with any product capable of implementing the above methods and systems, or the numerous possible variations thereof.

Various implementations of the systems and techniques described here can be realized in digital electronic circuitry, integrated circuitry, specially designed ASICs (application-specific integrated circuits), computer hardware, firmware, software, and/or combinations thereof. These various implementations can include implementation in one or more computer programs that are executable and/or interpretable on a programmable system including at least one programmable processor, which may be special or general-purpose, coupled to receive data and instructions from, and to transmit data and instructions to, a storage system, at least one input device, and at least one output device.

These computer programs (also known as programs, software, software applications, or code) include machine instructions for a programmable processor, and can be implemented in a high-level procedural and/or object-oriented programming language, and/or in assembly/machine language. As used herein, the terms "machine-readable medium" and "computer-readable medium" refer to any computer program product, apparatus, and/or device (e.g., magnetic discs, optical disks, memory, Programmable Logic Devices (PLDs)) used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

A person having ordinary skills in the art will appreciate that the system, modules, and sub-modules have been illustrated and explained to serve as examples and should not be considered limiting in any manner. It will be further appreciated that the variants of the above-disclosed system elements, or modules and other features and functions, or alternatives thereof, may be combined to create other different systems or applications.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

While in the foregoing specification, several embodiments of the invention have been set forth for purposes of making a complete disclosure, it will be apparent to those skilled in the art that numerous changes may be made without departing from the spirit and principles of the invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Although the present invention has been explained about its some embodiments, it is to be understood that many other possible modifications and variations can be made without departing from the Spirit and Scope of the invention as hereinafter claimed.

What is claimed is:

1. A projectile launching apparatus, comprising:

a launch barrel, partially within a water body, to engage a projectile;

a plurality of hinged doors along a length of the launch barrel;

a movable piston, wherein the projectile is placed on the movable piston;

a plurality of piston locks, wherein the plurality of piston locks includes a first set of piston locks at a bottom of the launch barrel and a second set of piston locks at a top of the launch barrel, and the first set of piston locks is configured to hold the piston at the bottom of the launch barrel before launch of the projectile;

a control unit configured to control the plurality of hinged doors to an open position, wherein in the open position of the plurality of hinged doors, water from the water body flows into the launch barrel to apply pressure on the piston, the piston is configured to move upwards along the length of the launch barrel from the bottom of the launch barrel to the top of the launch barrel based on the pressure applied by the flowing water on the piston from the water, the projectile is launched from the launch barrel based on the movement of the piston from the bottom to the top of the launch barrel, and the second set of piston locks is configured to hold the piston at the top of the launch barrel after the launch of the projectiles a plurality of inlets in the launch barrel; and a water pump at the bottom of the launch barrel, wherein the water pump is configured to pump the water out of the launch barrel through the plurality of inlets after the launch of the projectile, and after the launch of the projectile from the launch barrel, the piston is further configured to move downwards from the top of the launch barrel towards the bottom of the launch barrel based on the pumping out of the water from the launch barrel.

2. The projectile launching apparatus of claim 1, further comprising an engine connected with the projectile, wherein after the launch of the projectile from the launch barrel, the engine is configured to use fuel to allow the projectile to reach a specific position.

3. The projectile launching apparatus of claim 1, further comprising a pressure sensor configured to measure water pressure within the launch barrel.

4. The projectile launching apparatus of claim 1, wherein the launch barrel is hollow.

5. The projectile launching apparatus of claim 1, wherein a first portion of the launch barrel is above a top surface of the water body, and a second portion of the launch barrel is immersed within the water body.

6. The projectile launching apparatus of claim 5, wherein a length of the second portion is at least 10 kilometers.

* * * * *